US007909542B2

(12) United States Patent
Erasmus et al.

(10) Patent No.: US 7,909,542 B2
(45) Date of Patent: Mar. 22, 2011

(54) MINE SUPPORT

(75) Inventors: Nico Erasmus, Westonaria (ZA); Joseph Cornelius Visagie, Westonaria (ZA)

(73) Assignee: Grinaka-LTA Limited, Westonaria (ZA)

( * ) Notice: Subject to any disclaimer, the term of this patent is extended or adjusted under 35 U.S.C. 154(b) by 402 days.

(21) Appl. No.: 10/534,168

(22) PCT Filed: Nov. 6, 2003

(86) PCT No.: PCT/ZA03/00168

§ 371 (c)(1),
(2), (4) Date: Nov. 20, 2006

(87) PCT Pub. No.: WO2004/044382

PCT Pub. Date: May 27, 2004

(65) Prior Publication Data

US 2007/0092344 A1 Apr. 26, 2007

(30) Foreign Application Priority Data

Nov. 8, 2002 (ZA) ..... 2002/9083

(51) Int. Cl.
*E21D 15/00* (2006.01)

(52) U.S. Cl. ..... 405/288

(58) Field of Classification Search .. 52/FOR. 103–106, 52/109, 831, 834; 264/32, 34; 405/288, 405/257, 250, 249, 251, 252, 231, 232, 233
See application file for complete search history.

(56) References Cited

U.S. PATENT DOCUMENTS

| | | | | | |
|---|---|---|---|---|---|
| 881,609 | A | * | 3/1908 | Nellen et al. | 248/354.2 |
| 1,895,053 | A | * | 1/1933 | Staley | 248/354.2 |
| 3,779,025 | A | * | 12/1973 | Godley et al. | 405/249 |
| 4,052,029 | A | * | 10/1977 | Townsend | 248/548 |
| 4,565,469 | A | | 1/1986 | Chlumecky | |
| 6,558,085 | B1 | * | 5/2003 | Hall | 405/288 |

FOREIGN PATENT DOCUMENTS

| | | | |
|---|---|---|---|
| DE | 2410976 | A * | 9/1974 |
| DE | 3624928 | A1 | 1/1988 |
| DE | 299 08 546 | U1 | 8/1999 |
| WO | WO 00/14384 | | 3/2000 |

* cited by examiner

*Primary Examiner* — Sunil Singh
(74) *Attorney, Agent, or Firm* — Tutunjian & Bitetto, P.C.

(57) ABSTRACT

A mine support having a ductile metal sleeve, an interior of which is filled with a first aerated cementitious material of a first density which extends over at least 60% of the axial length of the sleeve. The interior of the sleeve is also filled with a second aerated cementitious material of a second density, which is less than the first density, and which fills the remainder of the interior of the sleeve.

8 Claims, 3 Drawing Sheets

40
42
16
32
36
34
10
18
22
30
28
14
24

MINE SUPPORT

BACKGROUND OF THE INVENTION

This invention relates to a mine support suitable for use in an underground excavation to provide support between a footwall and an opposed hanging wall.

Large excavations of the type encountered, for example, in coal mines wherein coal seams are removed using mechanised methods such as continuous coal miners, require substantial supports. These supports may for example be constructed by stacking a large quantity of wooden or concrete slabs one over the other to form a pack. Although this approach can work it is tedious and expensive. For example if the excavation height is in excess of, say, 3 m a large number of slabs must be stacked on one another to obtain the required height and, moreover, the cross sectional area of the stack must be sufficiently large to ensure that the height to area ratio of the stack is acceptable and stable under the operating conditions.

In an alternative approach to the problem it is known to make use of a tubular column which is completely filled with a yieldable material. The column is placed in position, in the excavation, using a suitable machine. This approach substantially reduces the amount of time needed to provide a support. On the other hand the characteristics of the yieldable material are such that, again, the cross sectional area of the support must be significant in order to achieve an acceptable height to cross sectional area ratio for the column. For example with a column height of the order of 3.5 m a column diameter of about 900 mm is required. Thus it is necessary to take careful consideration of the size of the column and its cost before making a decision to use a column of this type.

Similar problems and considerations present themselves when providing support in areas wherein elongate supports such as timber or steel props are used in that if the slenderness ratio of the prop (the ratio of its length or height to its cross sectional area) is too large, the prop may fail catastrophically, eg. by bending or snapping, under load instead of gradually yielding in a controlled manner.

SUMMARY OF INVENTION

The invention provides a mine support which includes a deformable tubular sleeve, a first material with a first strength characteristic inside, and filling, a first interior portion of the sleeve, and a second material with a second strength characteristic which differs from the first strength characteristic inside, and filling, a second interior portion of the sleeve.

The first interior portion may be adjacent the second interior portion. The length of the first interior portion, in an axial direction of the sleeve, may be greater than the length of the second interior portion in the axial direction of the sleeve.

The length of the first interior portion may vary according to requirement and may be in excess of 60% of the axial length of the sleeve, and preferably is from 70% to 90% of the axial length of the sleeve. Similarly the length of the second interior portion may vary according to requirement and may be up to 40% of the axial length of the sleeve and preferably is in the range of from 30% to 10% of the axial length of the sleeve.

The first material may comprise a lightweight cementitious mixture, for example foamed or aerated concrete.

The second material may comprise a lightweight cementitious mixture, for example a foamed or aerated concrete.

The first material may be stronger than the second material ie. it may have a higher hardness or greater density.

The density of the first material may be in excess of 900 $kg/m^3$ and typically lies in the range of from 1000 to 1100 $kg/m^3$.

The density of the second material may be less than 1000 $kg/m^3$ and typically lies in the range of from 800 to 900 $kg/m^3$.

It is to be understood that these densities values are given only by way of example and can be varied according to requirement to produce different yield characteristics.

The tubular sleeve may comprise any suitable material and preferably is made from a ductile metal. The thickness of the metal, eg. mild steel, may lie in the range of from 1.6 mm to 3.0 mm.

In a different form of the invention the sleeve is made from a frangible material such as plastic, fibre, reinforced concrete, resin impregnated paper, or the like which, under load, may break in relatively small steps instead of elastically deforming in the manner of a ductile metal.

The sleeve may have a length of up to 4.5 m and the diameter of the sleeve may be of the order of 600 mm.

With a shorter sleeve of about 3.6 m the diameter may be about 450 mm. On the other hand when the principles of the invention are used to provide elongate supports as alternatives to traditional timber or steel props the sleeve length may range from 1.5 m to 2.1 m and its diameter may vary from 150 to 200 mm.

The aforementioned values are illustrative only and are not binding. An important aspect in this respect is that, under load, the mine support should display a controlled load bearing versus yield characteristic, and should not be too strong for it is then liable to "punch" a hole in a closing hanging wall, or else fail suddenly.

The invention also provides a mine support which includes a ductile metal sleeve an interior of which is filled with a first aerated cementitious material of a first density which extends over at least 60% of the axial length of the sleeve, and with a second aerated cementitious material of a second density, which is less than the first density, and which fills a remainder of the interior of the sleeve.

BRIEF DESCRIPTION OF THE DRAWINGS

The invention is further described by way of example with reference to the accompanying drawings in which.

DESCRIPTION OF PREFERRED EMBODIMENT

Figure 1:
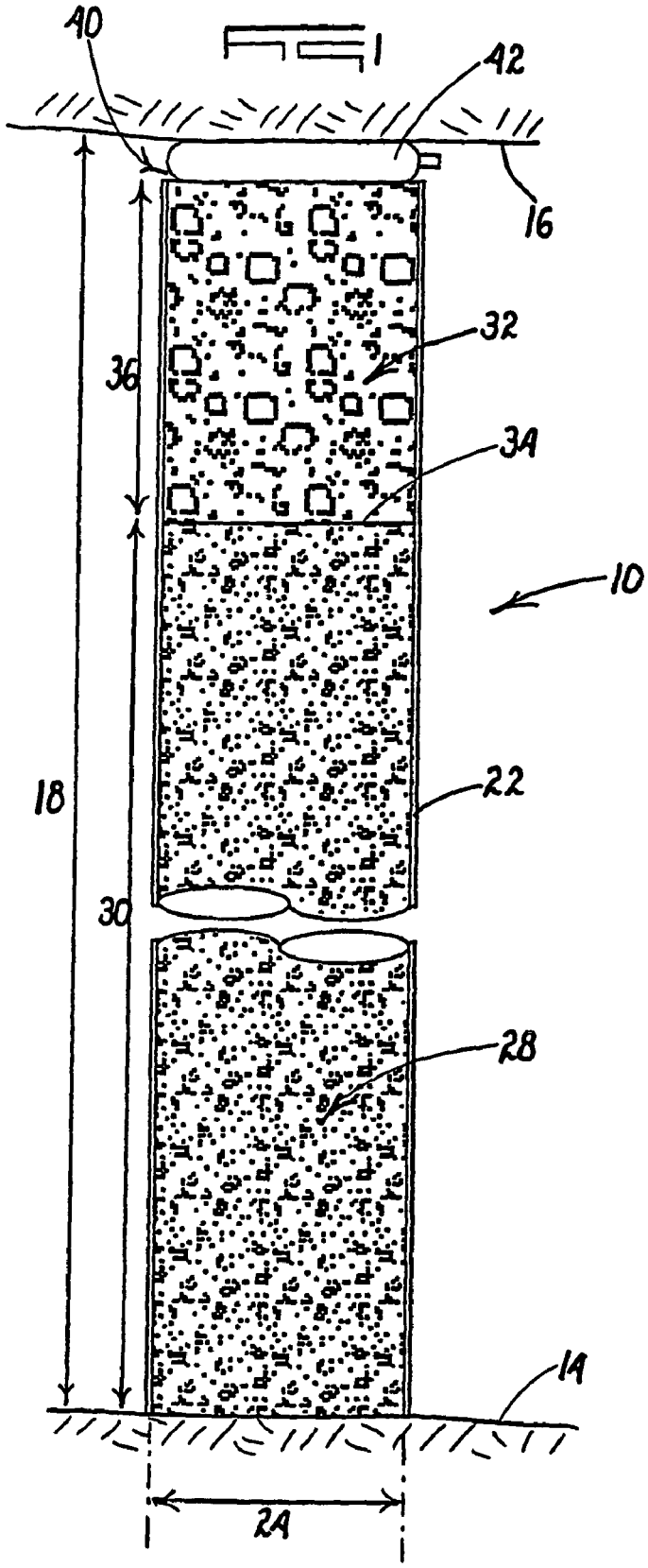
FIG. 1 illustrates from the side and in cross section a mine support according to the invention.

FIG. 1 of the accompanying drawings illustrates a mine support 10 positioned in an underground excavation 12, extending between a footwall 14 and an opposed hanging wall 16 of the excavation.

The height 18 of the excavation may be substantial and normally is of the order of from 3 to 5.5 m.

The support 10 includes a tubular sleeve 22 which may be made from a ductile metal like mild steel, reinforced concrete, plastic, resin impregnated paper etc. The tubular sleeve is circular and has a diameter 24, which varies according to requirement, but which typically is of the order of 450 mm. If the sleeve is made from mild steel, the thickness of the steel normally lies in the range of from 1.6 mm to 2.5 mm.

On surface or underground, depending on the available facilities, the sleeve interior is filled with a first cementitious mixture 28 which extends from one end of the sleeve over a first portion 30 of the length of the sleeve. The mixture 28 is a lightweight cementitious mixture made from aerated concrete and has a density in the range of 1000 to 1100 kg/m$^3$.

Once the mixture 28 has set the remainder of the sleeve interior is filled with a second lightweight foamed or aerated cementitious mixture 32 which has a density in the range of from 600 to 900 kg/m$^3$. The mixture 32 contacts an inner surface 34 of the mixture 28 and, as stated, extends over the remainder of the length of the sleeve, designated 36, to the respective end of the sleeve.

The support is fabricated under controlled conditions to ensure that the support complies with technical specifications. The support is transported to an installation site in an underground location using mechanised means. If the sleeve is too long for the particular excavation in which it is to be used then it is reduced in length by cutting off a section of the sleeve, and its cementitious interior.

At the installation site the support is erected in a vertical position using a device such as a modified fork lifter. FIG. 1 illustrates that an upper end 40 of the support is spaced slightly from an opposed surface of the hanging wall 16. A prestressing bag or device 42 of a kind which is known in the art is then positioned in the gap between the end 40 and the hanging wall 16 and is actuated to place the support under axially directed loading. This aspect is known in the art and therefore is not further described herein.

When closure of the hanging wall towards the footwall takes place the less dense material 32, which is not as strong as the more dense material 28, starts yielding. The material 28 does not yield, at least initially. As the material 32 yields the corresponding portion of the sleeve 22 is deformed axially and radially. When the material 32 has yielded to the maximum extent a further increase of the force which is exerted by the closure event must occur before the material 28 will yield.

The support of the invention is based on the principle that the material 28, which is stronger than the material 32, extends over a greater portion of the length of the support and consequently imparts significant strength and rigidity to the support. This enables the cross sectional area of the support to be reduced. On the other hand in order to allow for the support to yield in a controlled way, under load, the material 32 is made weaker than the material 28. The length 36 is significantly less than the length 30 and the provision of the weaker material 32 does not materially effect the stiffness of the support. As the support is not normally required to yield over its full length, for this would mean that the excavation in which it is used has become completely closed, a decision is taken on the degree of yielding which is required and the length 36 of the material 32 is established in accordance with this decision.

It follows that the overall dimensions of the support of the invention can be reduced significantly compared to the case in which a tubular support is formed from a sleeve filled with only one type of material.

Figure 2:
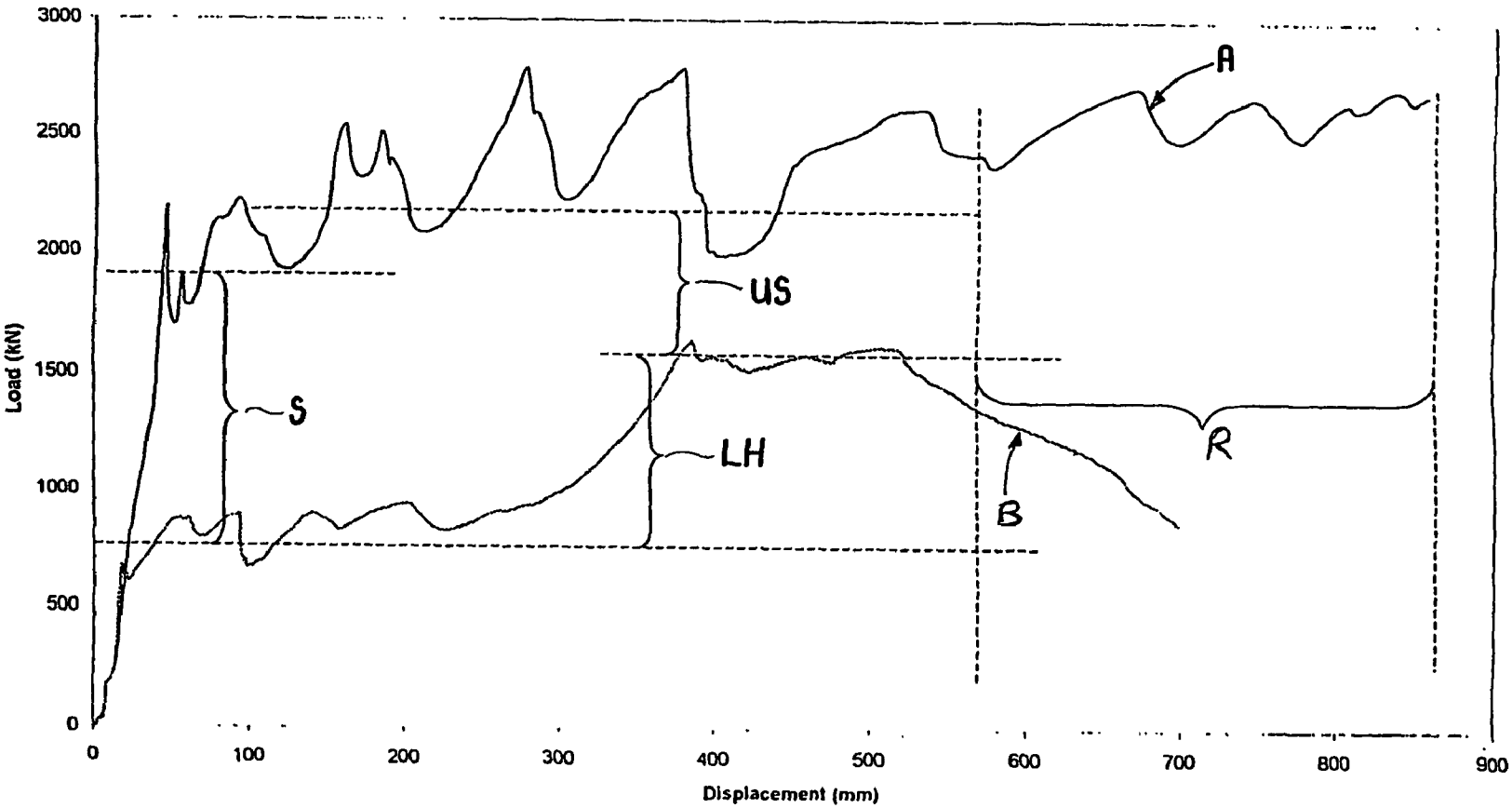
FIGS. 2 and 3 include curves of load versus displacement or yield for different types of mine supports.
Figure 3:
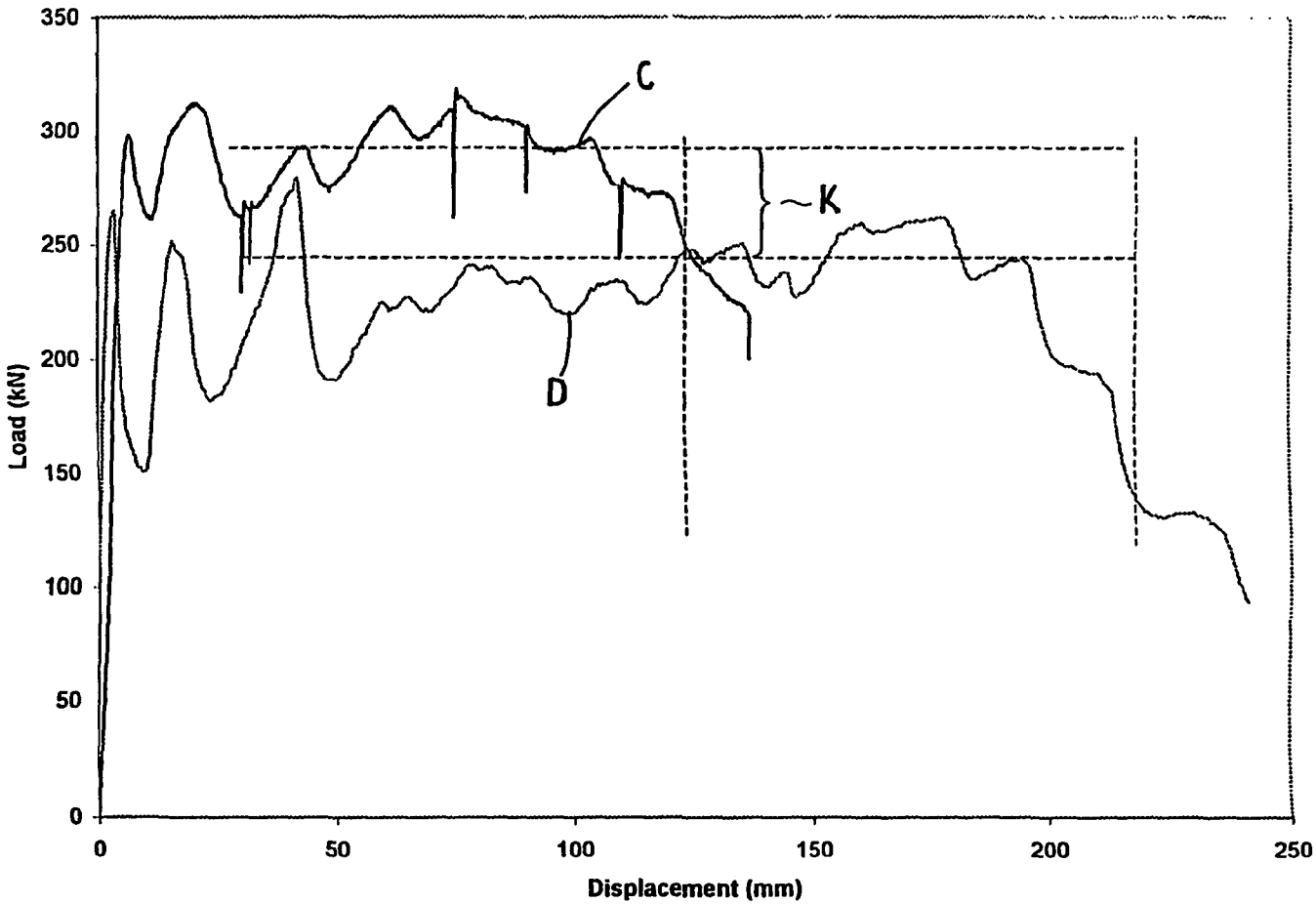

FIGS. 2 and 3 illustrate curves of load versus displacement for different mine supports, obtained under laboratory conditions.

FIG. 2 includes two curves marked A and B respectively. Curve A reflects the load/yield characteristic for a ductile metal sleeve with a length of 3.6 m and a diameter of 900 mm, filled with single density lightweight cementitious material. Curve B is the load/yield characteristic of a support prop formed from a ductile metal sleeve with a length of 3.6 m and a diameter of 450 mm filled, over 70% of its length, with a first cementitious mixture with a density higher then that used for the prop in curve A and, over the remaining 30% of the interior of the sleeve, with a second cementitious mixture which has a density the same as that used for the prop in curve A, as indicated in the preceding description.

The dual density support uses about ¼ of the material of the single density support. Notwithstanding the significantly smaller quantity of material used in the dual density support the difference between the ultimate strengths of the two supports, designated by the numeral US, is relatively small. The single density support deforms over a substantial range while the dual density support has considerable deformation but not quite as much as the single density support. The difference between the two deformation ranges is represented by the reference R.

It is evident that the initial strength of the dual density support is less than that of the single density support with the difference being indicated by the reference S. An inspection of the curve B shows that the initial strength characteristic, with small displacement, is due primarily to the lower density material and thereafter the strength increases to a value which is determined primarily by the higher density material, the difference being indicated by the reference LH.

FIG. 3 has two curves marked C and D respectively. The former curve is for an elongate support with a length of 1.5 m and a diameter of 150 mm filled with single density cementitious material. The curve marked D is for a dual density elongate support which has the same dimensions (length=1.5 m and diameter=150 mm) and which is filled over 70% of its length with a high density cementitious material and over the remaining 30% of its length with a low density cementitious material. In each case the densities of the cementitious materials are in the ranges indicated in the preceding description.

As is to be expected the support with the single density material has a higher initial strength before yielding but, significantly, it has a relatively low yielding range, about 125 mm, before failing. The dual density support on the other hand is capable of deforming over a significantly greater range, of the order of 220 mm, before failing. The increased yielding capability is achieved with only a small reduction in the ultimate strength of the prop, designated by the reference K in FIG. 3.

It is possible to extend the principles which have been described by including a third material which is weaker (less dense) than the materials 28 and 32 inside the sleeve. This will provide a support which has three stages of different yielding characteristics It is also possible to position the material 28 between material 32 which is positioned at one end of the sleeve and similar material 32 positioned at an opposing end of the sleeve. In other words each end of the sleeve would therefore yield when subjected to axial loading and thereafter the material 28 would start yielding.

The material 32 is preferably aerated concrete. It is possible though to weaken a suitable concrete mix in other ways for example by forming voids or holes in the concrete which, when axially loaded, promote yielding in a controlled manner.

Principles similar to those described can be used to manufacture smaller supports in the nature of elongate props which have lengths in the range of, say, 1.5 m to 2.1 m and diameters in the range of, say, 150 mm to 200 mm.

The sleeve is preferably a ductile metal which elastically deforms under load, without breaking. The sleeve can however be made from fibre glass, concrete, plastic or a like material which breaks, as opposed to deforming elastically, under load. Generally this will still result in the support having a load versus yield characteristic of a satisfactory shape but the values at which yielding takes place will be lower than what is the case with a metal sleeve.

Materials, other than cementitious mixtures, can be used inside the sleeve. Use could for example be made of low and high density timber, foamed plastic materials or the like, but important factors in this respect are cost and predictable and repeatable physical characteristics which allow the properties of the support, in use, to be reliably ascertainable.

The invention claimed is:

1. A mine support for use in an underground excavation with a hanging wall and an opposed foot wall, the mine support comprising:

a single deformable tubular sleeve with a circular cross section which is made from a ductile metal and which has a first end and an opposed second end, the sleeve being positioned in the excavation with the first end directly engaged with one of the hanging wall and the foot wall and the second end engaged with the other of the hanging wall and the foot wall by means of a pre-stressing device, a first aerated cementitious material with a first strength characteristic inside a first interior portion of the sleeve and filling said first interior portion of the sleeve;

a second aerated cementitious material with a second strength characteristic which differs from the first strength characteristic inside a remainder portion of the sleeve interior and filling said remainder portion of the sleeve interior; and the first interior portion having a length, in an axial direction of the sleeve, which is greater than the length of the remainder portion of the sleeve interior in the axial direction of the sleeve and wherein said second aerated cementitious material only overlies the first aerated cementitious material, wherein the first cementitious material is stronger than the second cementitious material.

2. A mine support according to claim 1 wherein the first interior portion is adjacent the-remainder portion of the sleeve interior.

3. A mine support according to claim 1 wherein the first interior portion has a length in an axial direction of the sleeve of from 70% to 90% of the axial length of the sleeve.

4. A mine support according to claim 1 wherein the remainder portion of the sleeve interior has a length in an axial direction of the sleeve of from 10% to 30% of the axial length of the sleeve.

5. A mine support according to claim 1 wherein the density of the first material lies in the range of from 1000 to 1100 $kg/m^3$.

6. A mine support according to claim 5 wherein the density of the second material lies in the range of from 800 to 900 $kg/m^3$.

7. A mine support according to claim 1 wherein the sleeve is made from mild steel with a thickness in the range of from 1.6 mm to 3.0 mm.

8. A mine support according to of claim 1 wherein the sleeve has an axial length in the range of from 1.5 m to 4.5 m and a diameter in the range of from 150 mm to 600 mm.

* * * * *